US006620264B2

(12) United States Patent
Kündig et al.

(10) Patent No.: US 6,620,264 B2
(45) Date of Patent: Sep. 16, 2003

(54) CASTING OF AMORPHOUS METALLIC PARTS BY HOT MOLD QUENCHING

(75) Inventors: Andreas A. Kündig, Niederurnen (CH); William L. Johnson, Pasadena, CA (US); Alex Dommann, Schweiz (CH)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 09/879,545

(22) Filed: Jun. 11, 2001

(65) Prior Publication Data

US 2002/0050310 A1 May 2, 2002

Related U.S. Application Data

(60) Provisional application No. 60/210,895, filed on Jun. 9, 2000.

(51) Int. Cl.[7] ..... C22C 45/00

(52) U.S. Cl. ..... 148/538; 148/561; 164/120; 164/138

(58) Field of Search ..... 148/538, 561; 164/120, 138

(56) References Cited

U.S. PATENT DOCUMENTS

| | | | | |
|---|---|---|---|---|
| 5,288,344 A | | 2/1994 | Peker et al. | 148/403 |
| 5,296,059 A | | 3/1994 | Masumoto et al. | 148/695 |
| 5,306,463 A | | 4/1994 | Horimura | 419/44 |
| 5,312,495 A | | 5/1994 | Masumoto et al. | 148/550 |
| 5,324,368 A | | 6/1994 | Masumoto et al. | 148/561 |
| 5,368,659 A | | 11/1994 | Peker et al. | 148/403 |
| 5,589,012 A | | 12/1996 | Hobby et al. | 148/561 |
| 5,711,363 A | | 1/1998 | Scruggs et al. | 164/113 |
| 5,735,975 A | | 4/1998 | Lin et al. | 148/403 |
| 5,740,854 A | * | 4/1998 | Inoue et al. | 164/495 |
| 5,797,443 A | | 8/1998 | Lin et al. | 164/4.1 |
| 5,950,704 A | | 9/1999 | Johnson et al. | 164/47 |

FOREIGN PATENT DOCUMENTS

JP 08-74010 * 3/1996

OTHER PUBLICATIONS

PCT International Search Report for PCT/US01/18759.

* cited by examiner

*Primary Examiner*—George Wyszomierski
(74) *Attorney, Agent, or Firm*—Knobbe, Martens, Olson & Bear LLP

(57) ABSTRACT

A manufacturing process for casting amorphous metallic parts separates the filling and quenching steps of the casting process in time. The mold is heated to an elevated casting temperature at which the metallic alloy has high fluidity. The alloy fills the mold at the casting temperature, thereby enabling the alloy to effectively fill the spaces of the mold. The mold and the alloy are then quenched together, the quenching occurring before the onset of crystallization in the alloy. With this process, compared to conventional techniques, amorphous metallic parts with higher aspect ratios can be prepared.

35 Claims, 8 Drawing Sheets

CASTING OF AMORPHOUS METALLIC PARTS BY HOT MOLD QUENCHING

CROSS-REFERENCE TO RELATED APPLICATION

This application claims the benefit of U.S. Provisional Application No. 60/210,895, filed Jun. 9, 2000, the entirety of which is hereby incorporated by reference.

BACKGROUND OF THE INVENTION

1. Field of the Invention

This invention relates to amorphous metallic alloys, commonly referred to as metallic glasses, and more particularly to a new process for the preparation of amorphous metallic components and tools, particularly with high aspect ratio features (ratio of height to width greater than one) in the micro- and submicrometer scale.

2. Description of the Related Art

Amorphous metallic alloys are metal alloys that can be cooled from the melt to retain an amorphous form in the solid state. These metallic alloys are formed by solidification of alloy melts by undercooling the alloy to a temperature below its glass transition temperature before appreciable homogeneous nucleation and crystallization has occurred. At ambient temperatures, these metals and alloys remain in an extremely viscous liquid or glass phase, in contrast to ordinary metals and alloys which crystallize when cooled from the liquid phase. Cooling rates on the order of $10^4$ or $10^6$ K/sec have typically been required, although some amorphous metals can be formed with cooling rates of about 500 K/sec or less.

Even though there is no liquid/solid crystallization transformation for an amorphous metal, a "melting temperature" $T_m$ may be defined as the temperature at which the viscosity of the metal falls below about $10^2$ poise upon heating. Similarly, an effective glass transition temperature $T_g$ may be defined as the temperature below which the equilibrium viscosity of the cooled liquid is above about $10^{13}$ poise. At temperatures below $T_g$, the material is for all practical purposes a solid.

Amorphous parts are typically prepared by injection casting the liquid alloy into cold metallic molds or by forming the parts in the superplastic state at temperatures close to the glass transition temperature ($T_g$). However, micrometer scale parts with high aspect ratios cannot be prepared by these processes. The aspect ratio of a part is defined as the ratio of height to width of the part. A part with a high aspect ratio is considered to have an aspect ratio greater than one.

Casting of a high aspect ratio part requires long filling times of the liquid alloy into the mold. However, because metallic alloys generally require high cooling rates, in an injection casting method, only small amounts of material can be made as a consequence of the need to extract heat at a sufficient rate to suppress crystallization. Moreover, cold mold casting does not enable the alloy to wet the mold effectively, thereby leading to the production of imprecise parts.

U.S. Pat. No. 5,950,704 describes a method for replicating the surface features from a master model to an amorphous metallic alloy by forming the alloy at an elevated replicating temperature. In this method, a piece of bulk-solidifying amorphous metallic alloy is cast against the surface of a master model at the replication temperature, which is described as being between about 0.75 $T_g$ to about 1.2 $T_g$, where $T_g$ is measured in ° C. However, at these temperature ranges, the alloy material is still fairly viscous. Thus, forming high aspect ratio parts is difficult because the alloy may not be fluid enough to fill the shape of the mold in a fast enough time before the onset of crystallization. Furthermore, due to the high viscosity of the alloy, high pressures are needed to press the alloy against the model.

Accordingly, what is needed is an improved method and apparatus for the formation of amorphous metallic parts, and more particularly, a method and apparatus for the formation of high aspect ratio amorphous metallic parts.

SUMMARY OF THE INVENTION

The needs discussed above are addressed by the preferred embodiments of the present invention which describe a manufacturing process that separates the filling and quenching steps of the casting process in time. Thus, in one embodiment, the mold is heated to an elevated casting temperature at which the metallic alloy has high fluidity. The alloy fills the mold at the casting temperature, thereby enabling the alloy to effectively fill the spaces of the mold. The mold and the alloy are then quenched together, the quenching occurring before the onset of crystallization in the alloy. With this process, compared to conventional techniques, amorphous metallic parts with higher aspect ratios can be prepared.

In one aspect of the present invention, a method of forming an amorphous metallic component is provided. A mold is provided having a desired pattern thereon. An alloy capable of forming an amorphous metal is placed in contact with the mold. The mold and the alloy are heated to a casting temperature above about 1.5 $T_g$ of the alloy to allow the alloy to wet the mold. The alloy is cooled to an ambient temperature to form an amorphous metallic component.

In another aspect of the present invention, the method of forming an amorphous metallic component comprises providing a mold having a desired pattern thereon. An alloy capable of forming an amorphous metal is placed in contact with the mold, and the mold and the alloy are heated to a casting temperature wherein the viscosity of the alloy is less than about $10^4$ poise, preferably less than about $10^2$ poise, to allow the alloy to wet the mold. The alloy is cooled to an ambient temperature to form an amorphous metallic component.

In another aspect of the present invention, the method of forming an amorphous metallic component comprises providing a mold having a desired pattern thereon. An alloy capable of forming an amorphous metal is placed in contact with the mold, and the mold and the alloy are heated to a casting temperature above the nose of the crystallization curve of the alloy to allow the alloy to wet the mold. The alloy is cooled to an ambient temperature to form an amorphous metallic component.

In another aspect of the present invention, a method of forming an amorphous metallic component having a high aspect ratio is provided. A mold is provided having a desired pattern thereon, wherein at least a portion of the mold includes a recess having a height greater than a width thereof. The mold is filled with a metallic alloy capable of forming an amorphous metal at an elevated casting temperature, wherein the metallic alloy has sufficient fluidity to substantially fill the recess before undergoing crystallization. The alloy is cooled from the casting temperature to an ambient temperature, the cooling occurring prior to crystallization of the metallic alloy, such that an amorphous metallic component is formed replicating the shape of the mold. Components formed by this method preferably have aspect ratios greater than about one, more preferably greater than about three.

DETAILED DESCRIPTION OF THE PREFERRED EMBODIMENTS

Figure 1:
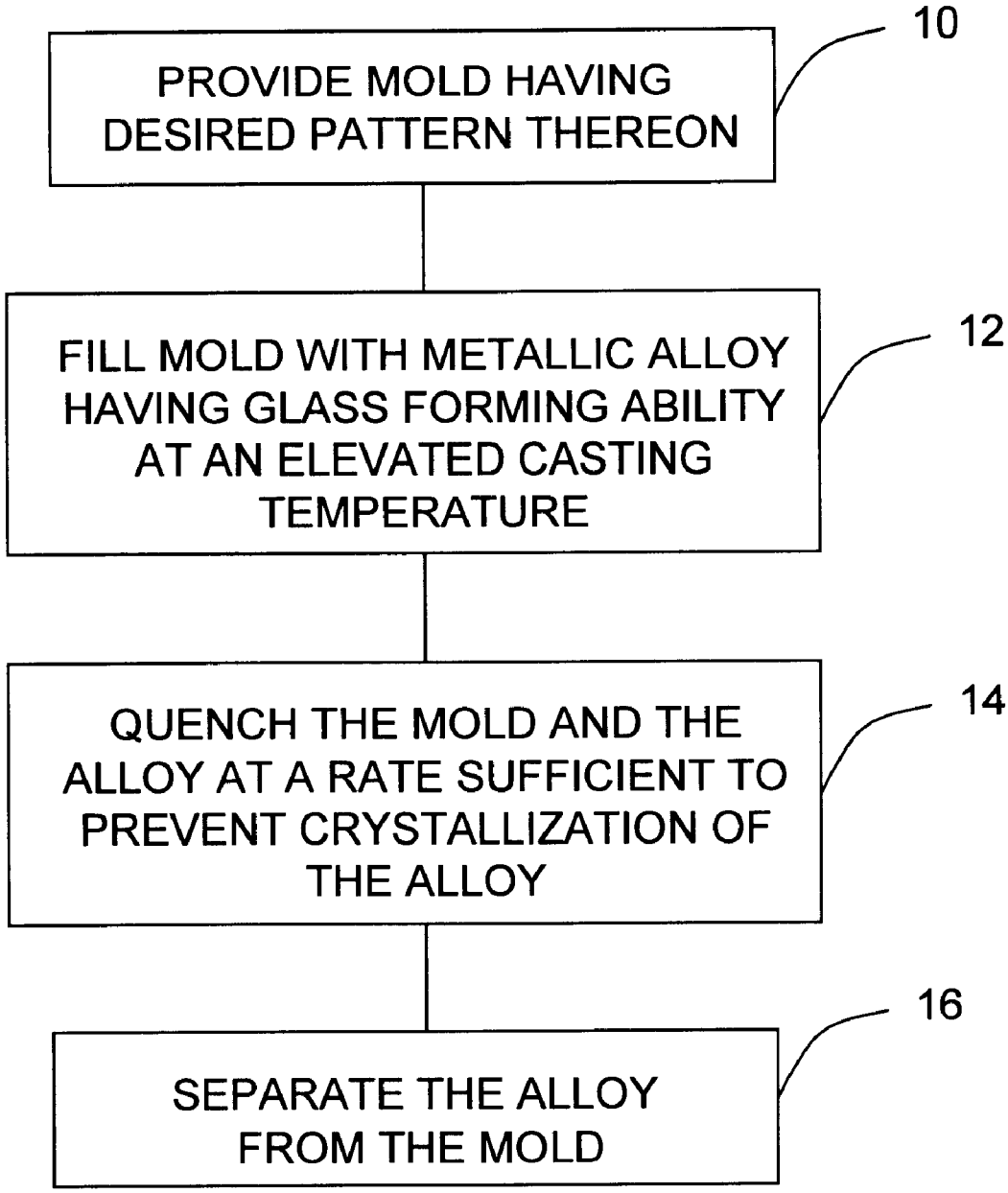
FIG. 1 is a flow chart illustrating the steps of forming an amorphous metallic alloy component according to one embodiment of the present invention.

FIG. 1 illustrates one preferred method for forming an amorphous metallic component. Briefly stated, in step 10, a mold or die with low thermal mass or low thermal conductivity and having a desired pattern thereon is provided. Next, in step 12, the mold is filled and wetted by a metallic alloy which shows glass forming ability. This step is preferably accomplished by heating both the mold and the alloy to an elevated casting temperature in which the alloy becomes extremely fluid, as described below. This enables the alloy to flow effectively into all of the crevices of the mold. In step 14, the mold and the alloy are quenched together at a rate sufficient to prevent crystallization of the alloy and form an amorphous solid. One preferred method of quenching the materials is by bringing the mold in contact with a heat sink, such as a cold copper block. In step 16, the alloy is separated from the mold.

Preferably, the mold used is one of two types, both of which allow the cooling of the alloy at high rates. The first type is a mold with a low thermal mass that can be cooled at high rates together with the alloy. In this case, the alloy and the mold can be cooled from both sides. Examples of suitable materials include, but are not limited to, silicon and graphite. More preferably, a suitable mold may have a thermal mass less than about 800 J/kg·K, even more preferably less than about 400 J/kg·K.

Another way to achieve the high cooling rates for the alloy is the use of a mold with low thermal conductivity. In this case, the alloy is preferably cooled only from the alloy's side, such as with a heat sink as described below. Examples of suitable materials include, but are not limited to, quartz. More preferably, a suitable mold may have a thermal conductivity less than about 5 W/m·K, more preferably less than about 2 W/m·K.

Optionally, the mold and the alloy may be separated by a protective layer or releasing layer. This layer may be native to the mold, such as a $SiO_2$ native oxide layer formed on a Si mold, described below. Other protective layers may also be used, including but not limited to amorphous carbon, silicon carbide and silicon oxynitride, and other suitable materials such as diffusion barriers (e.g., Ta—Si—N). The protective layer advantageously prevents reaction between the mold and the alloy and facilitates the subsequent separation of the mold from the alloy.

Figure 2:
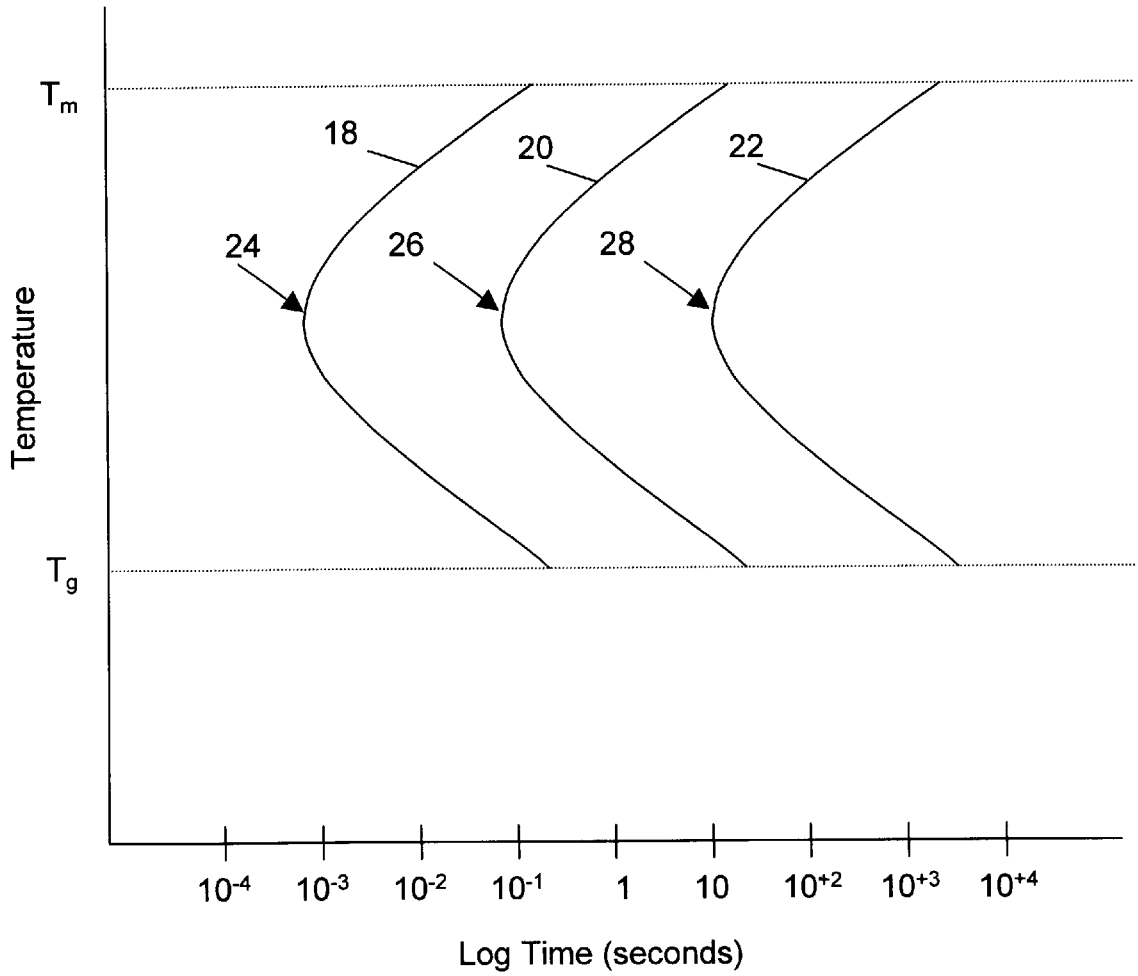
FIG. 2 is a schematic diagram of crystallization curves for three exemplifying amorphous metallic alloys.

In order to prevent crystallization in the alloy upon quenching, the alloy is desirably cooled at a sufficiently rapid rate. FIG. 2 illustrates schematically a diagram of temperature plotted against time on a logarithmic scale for three exemplifying amorphous metallic alloys. A melting temperature $T_m$ and a glass transition temperature $T_g$ are indicated. The illustrated curves 18, 20 and 22 indicate the onset of crystallization as a function of time and temperature for different amorphous metallic alloys. When the alloy is heated to a temperature above the melting temperature, in order to avoid crystallization, the alloy is cooled from above the melting temperature through the glass transition temperature without intersecting the nose 24, 26 or 28 of the crystallization curve.

Crystallization curve 18 indicates that for these types of amorphous metallic alloys, cooling rates in excess of about $10^5$–$10^6$ K/sec have typically been required. Examples of amorphous metallic alloys in this category include alloys in the systems Fe—B, Fe—Si—B, Ni—Si—B and Co—Si—B.

The second crystallization curve 20 in FIG. 2 indicates that for these alloys, cooling rates on the order of about $10^3$–$10^4$ K/sec are required. Examples of amorphous metallic alloys in this category include alloys in the system Pt—Ni—P and Pd—Si.

With the crystallization curve 22, cooling rates of less than about $10^3$ K/sec and preferably less than $10^2$ K/sec can be used. Examples of amorphous metallic alloys in this category include Zr-based alloys, as described below.

Figure 3:
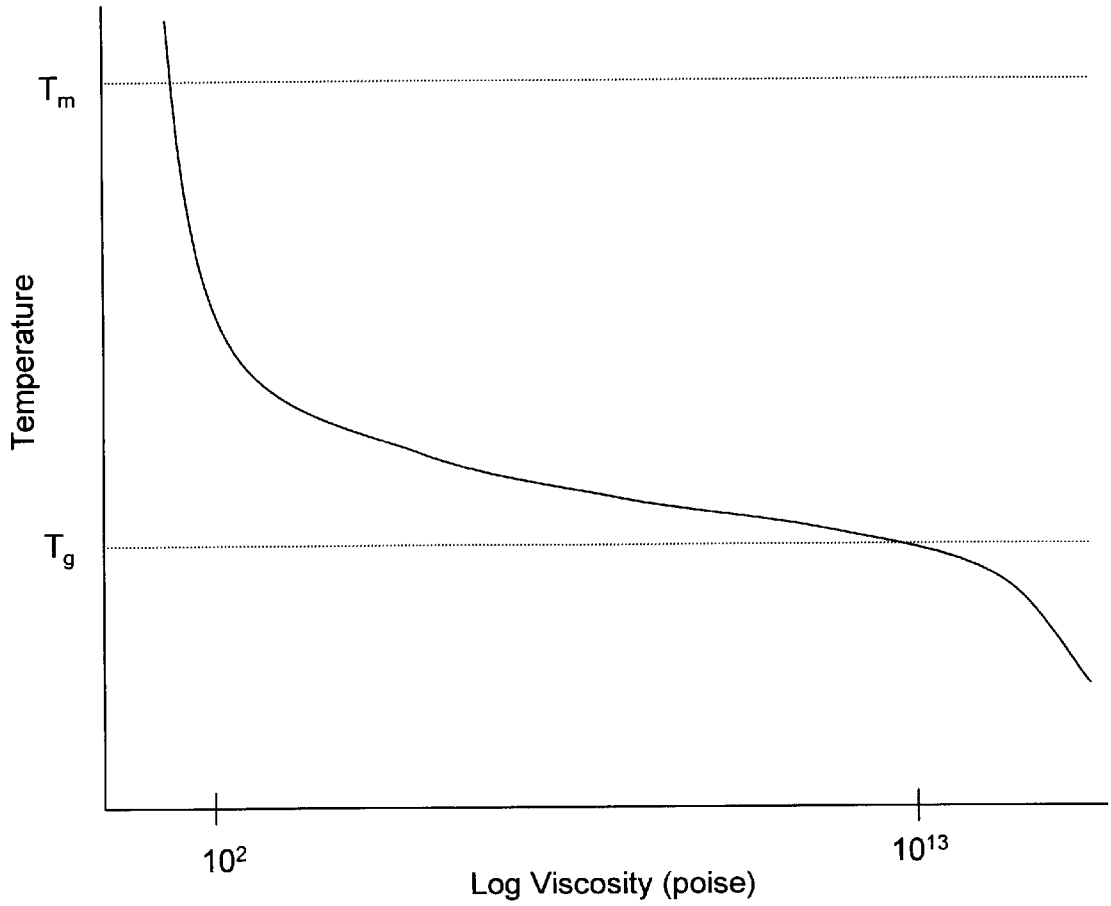
FIG. 3 is a schematic diagram illustrating the viscosity of an exemplifying amorphous metallic alloy as a function of temperature.

FIG. 3 is a schematic diagram of temperature and viscosity on a logarithmic scale for an undercooled amorphous alloy between the melting temperature and glass transition temperature. The glass transition temperature is typically considered to be a temperature where the viscosity of the alloy is in the order of about $10^{13}$ poise. A liquid alloy, on the other hand, is defined to have a viscosity of less than about $10^2$ poise. As shown in FIG. 3, as temperature is decreased from $T_m$, the viscosity of the alloy first increases slowly and then more rapidly as the temperature approaches $T_g$.

Referring again to FIG. 1, in step 12 the alloy is preferably heated to a preferred casting temperature at which a highly fluid alloy is formed. In one embodiment, this casting temperature is determined by the viscosity of the alloy. For example, the casting temperature may be the temperature at which the alloy has a viscosity below about $10^4$ poise, more preferably below about $10^2$ poise. In another embodiment, the casting temperature may simply be determined as a function of the melting temperature or the glass transition temperature. In one preferred embodiment, the alloy is heated above its melting temperature during step 12. However, it will be appreciated that it is not necessary to go above the melting temperature in order to obtain a highly fluid alloy. Thus, in one embodiment, temperatures greater than about 1.2 $T_g$ will be sufficient, more preferably above about 1.5 $T_g$, where $T_g$ is in ° C. A third method of determining casting temperature is simply to choose a temperature above the nose on the crystallization curve.

The fluidity of the alloy at these elevated casting temperatures allows wetting of the mold so that replication of fine features can be obtained. The high fluidity of the alloy also enables the use of lower pressures to press the alloy into the mold, as described below.

It will be appreciated that other methods may also be used to determine a suitable casting temperature. In general, because wetting of the alloy to the mold improves replication of the amorphous metallic part, any temperature at which suitable wetting of the alloy to the mold occurs can be used to determine a desired casting temperature.

Figure 4:
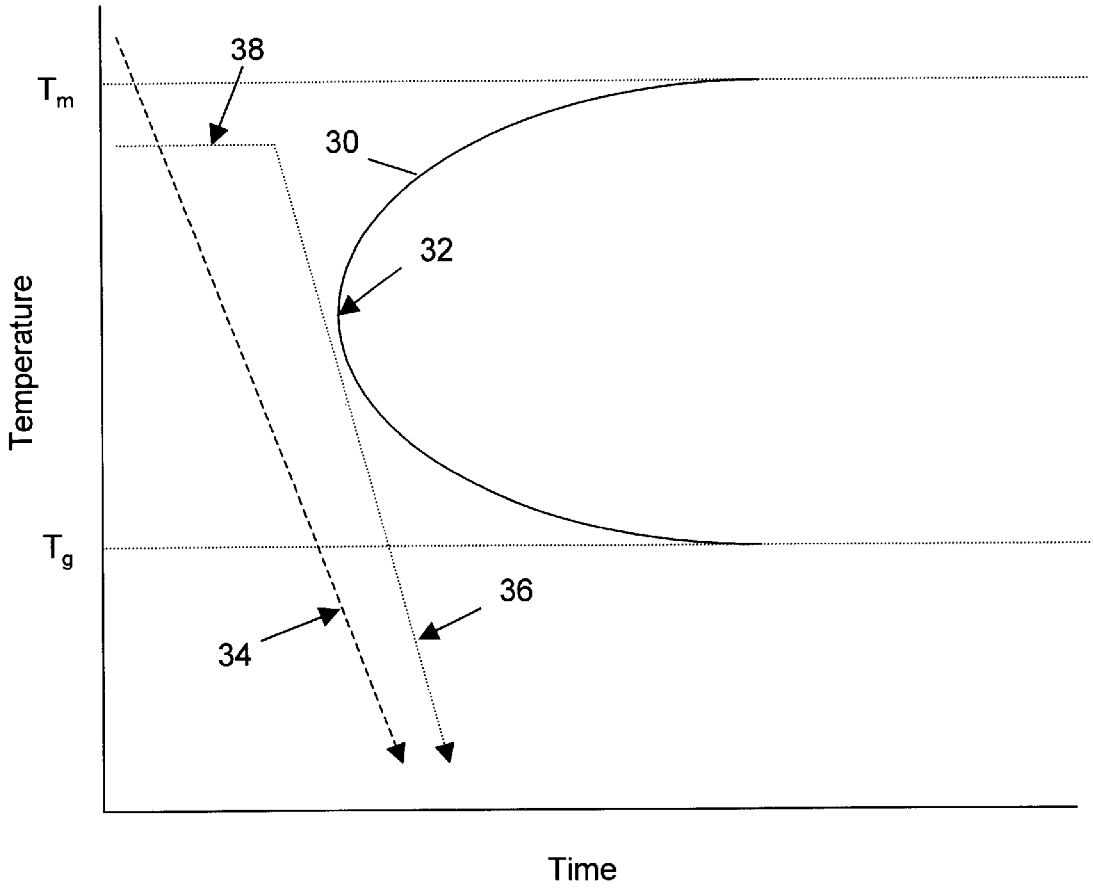
FIG. 4 is a schematic diagram of a crystallization curve illustrating preferred cooling rates of a metallic alloy into an amorphous phase.

FIG. 4 illustrates preferred cooling sequences for an amorphous metallic alloy having a crystallization curve 30, as shown. FIG. 4 illustrates that the amorphous metallic alloy is preferably selected such that when the alloy is cooled, the cooling graph 34 does not intersect the nose 32 of the curve 30. In the formation of high aspect ratio parts, it may also be desirable to hold the alloy in its high temperature state for a period of time in order to allow the alloy to fully wet the mold. This time, for example, may range between about 5 seconds and several minutes. When the casting process begins with the casting temperature of the alloy above $T_m$, as shown by graph 34, the alloy can be held at this temperature for theoretically an unlimited period of time while avoiding crystallization. Thus, while graph 34 shows only the quenching step in the production of the alloy, it will be appreciated that this quenching step can be preceded by a suitable holding period above $T_m$ to ensure suitable wetting of the mold.

FIG. 4 also illustrates a cooling graph 36 using a casting temperature below $T_m$. For the method illustrated by this graph, the time period 38 represents holding the alloy at the casting temperature. Because the alloy will crystallize if held at this temperature for too long, the alloy is held at the casting temperature for a short period of time, more preferably about 5 seconds to several minutes. As with cooling graph 34, cooling graph 36 illustrates quenching of the alloy at a sufficiently fast rate to avoid intersecting the nose 32 of the curve 34, thereby avoiding crystallization of the alloy.

Figure 5:
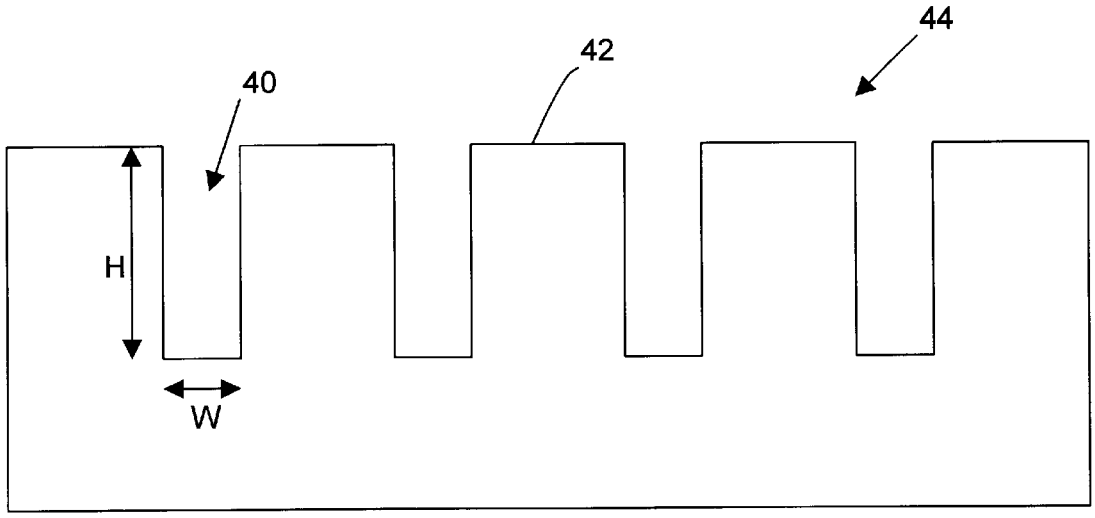
FIG. 5 is a cross-sectional view of the surface of a mold for forming high aspect ratio components.

Because the alloy described by the methods above effectively wets the mold, replication of the pattern on the mold is more precise than in cold mold casting. This is illustrated in FIG. 5, which shows an exemplifying mold having recesses formed therein for the formation of high profile parts. As illustrated, one or more of the recesses 40 on the surface 42 of the mold 44 has a height H and a width W, the height H being greater than the width W. In order to effectively wet the mold such that the entire groove is substantially filled with alloy, the fluidity of the alloy is preferably chosen such that the groove can be filled in a fast enough time without the onset of crystallization. FIG. 4 illustrates that after a period 38 of holding the alloy at the casting temperature, the alloy is quenched as shown in cooling graph 36 such that the quenching curve does not hit the nose 32.

A successful experiment for forming an amorphous metallic part was performed as follows. A mold was provided as a micro-structured silicon wafer. More particularly, the mold was a 4" wafer, prepared by deep reactive ion etching with test structures, 100 $\mu$m deep and 30 to 2000 $\mu$m wide. A protective layer formed on the silicon wafer was the native $SiO_2$, which is about 1 nm thick. Other molds can be used, having desirable properties of low thermal mass or low thermal conductivity. Other suitable materials for the mold include amorphous carbon.

A bulk glass forming alloy had the composition $Zr_{52.5}Cu_{17.9}Ni_{14.6}Al_{10}Ti_5$ with a melting point of about 800° C. and a critical cooling rate for glass forming of about 10 K/s. It will be appreciated, however, that other alloys can be used. For example, other Zr-based amorphous alloys may be used, such as Zr—Ti—Ni—Cu—Be alloys. Other alloys, such as disclosed in U.S. Pat. Nos. 5,950,704 and 5,288,344, the entirety of both of which are hereby incorporated by reference, also may be used.

Figure 6:
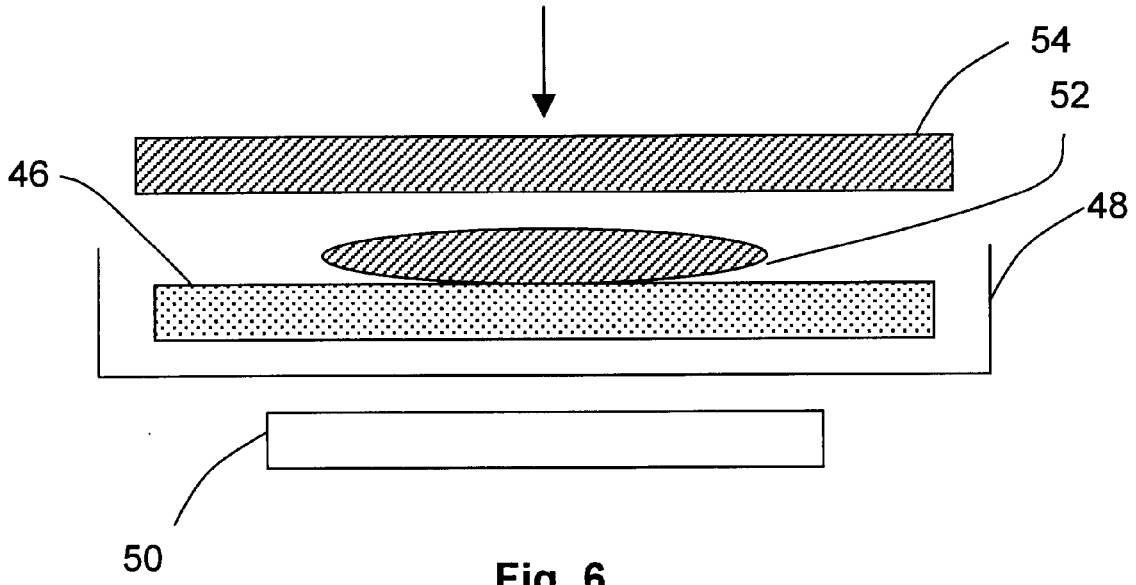
FIG. 6 is a schematic side view of an apparatus for forming an amorphous metallic alloy component according to the method of FIG. 1.

FIG. 6 illustrates schematically the set up in one embodiment for the preparation of amorphous metallic parts. The micro-structured silicon wafer 46 is preferably provided on a quartz support 48, which is supported over a heat source 50 such as an RF coil. The RF coil is used because it advantageously allows the heat supply to be stopped abruptly. It will be appreciated, however, that other heat sources may also be used, such as a hot plate which may be separated from the wafer before cooling in order to stop the heat supply.

In the illustrated example, the amorphous metallic alloy 52 was placed onto the silicon wafer 46. The sample alloy may take any desirable form, and in the example illustrated, a 5 g button of alloy was used. The experiment was performed in a vacuum chamber at $10^{-5}$ mbar.

The alloy and the mold were heated to above its melting temperature to about 1000° C. by the RF coil 50 positioned below the quartz disc 48. After reaching this elevated casting temperature a copper block 54 at room temperature was lowered and pressed onto the alloy. The copper block was lowered onto the alloy after about 2 to 5 seconds at the casting temperature. The copper block was preferably lowered onto the alloy at a rate between about 0.01 and 1 m/s, with better results achieved using higher speeds. Because of the high fluidity of the metallic alloy, a relatively low pressure of about 0.01 to 0.1 N was used to press the copper block.

The alloy 52 wetted the wafer 46 on a circle of about 10 mm and was spread out and cooled by the copper block to a disc of about 30 mm in a diameter and 1 mm in thickness. Cooling of the alloy 52 preferably occurred at a sufficiently rapid rate to avoid crystallization of the alloy, more preferably at a rate of up to about 100 K/sec. After cooling, the silicon was removed from the alloy by etching it about 72 hours in concentrated KOH solution.

The topology of the amorphous disc was investigated with an optical microscope. The volume of the mold features was approximately 95% filled. There was no apparent difference between regions which had wetted the silicon wafer during heating and those which had been produced when the melt flowed outward under pressure onto exposed silicon.

Figure 7A:
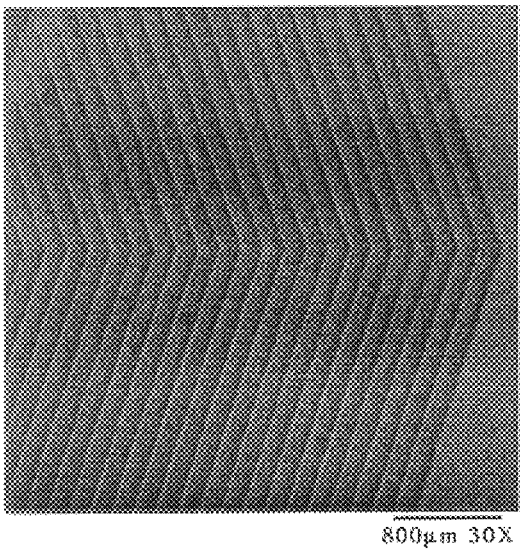
FIGS. 7A and 7B are SEM pictures of a first replicated structure made according to one embodiment of the present invention, showing the structure at 30× and 300× magnification.
Figure 7B:
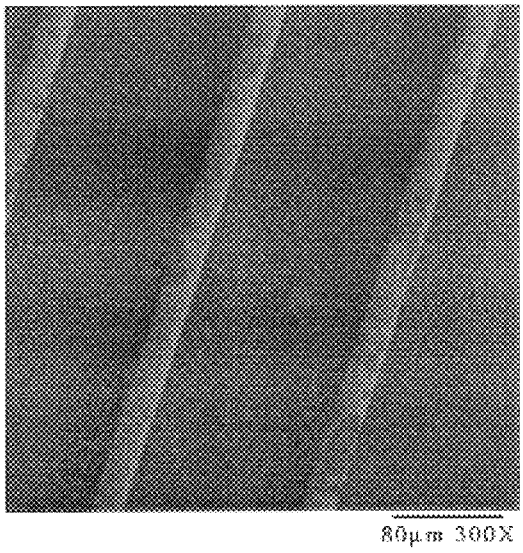

FIGS. 7A and 7B are SEM pictures of an amorphous metallic component formed according to the above procedure. More particularly, these figures illustrate a replicated structure having walls of about 30 $\mu$m in width, and a depth of about 100 $\mu$m. FIG. 7A shows the structure at 30× magnification, and FIG. 7B shows the structure at 300× magnification. Such a component can preferably be made using a mold having a surface structure similar to that shown in FIG. 5, where the walls have a width W which is about 30 $\mu$m and a height H which is about 100 $\mu$m. Thus, these pictures illustrate that the methods described above are capable of forming amorphous metallic parts having aspect ratios greater than about three in the micrometer scale.

Figure 8A:
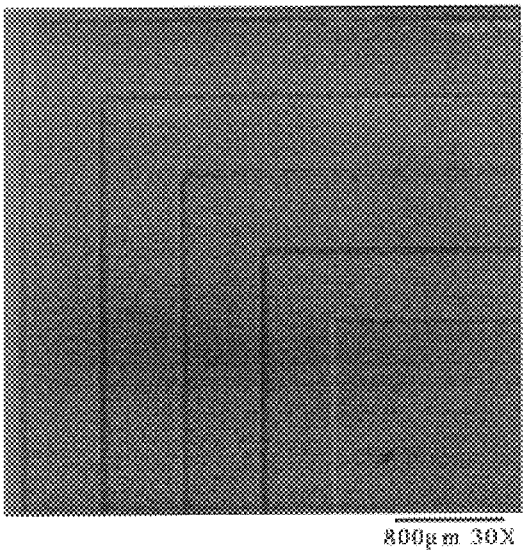
FIGS. 8A and 8B are SEM pictures of a second replicated structure made according to one embodiment of the present invention, showing the structure at 30× and 300× magnification.
Figure 8B:
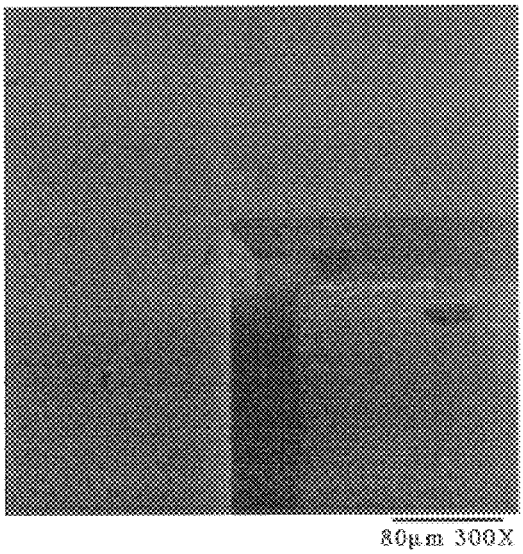

FIGS. 8A and 8B are SEM pictures of another amorphous metallic component formed according to the above procedure. These figures illustrate a replicated structure having channels that are about 40 $\mu$m wide and 100 $\mu$m deep. FIG. 8A shows the structure at 30× magnification, and FIG. 8B shows the structure at 300× magnification.

As shown in the pictures described above, amorphous metallic components can be formed having extremely fine surface features. These components, by virtue of being amorphous metals, also take advantage of at least one of the following properties: mechanical properties (e.g. high elastic deformation, high hardness), chemical properties (e.g. corrosion resistivity, catalytic properties), thermal properties (e.g. continuous softening and increase of diffusivity, low melting point) or functional properties (e.g. electronic, magnetic, optic). Thus, a finely replicated part having one or more of the above desired properties is desirably formed by the above-described procedures.

One example of an application for which the formation of high aspect ratio parts may be desirable is injection molding of polymers (e.g. for disposable culture dishes in medicine). In one experiment, replicated amorphous metallic structures were tested as tools for micro polymer injection casting. About 100 replications with polycarbonate were performed, with complete replication into a polymer part being made using amorphous metallic casters. The observed parts of the metallic glass tool that were completely amorphous before casting did not show any damage after the replications.

It will be appreciated that various microstuctures may be formed using the preferred methods described above. High aspect ratio parts, for example, can be made for microfluidic and microoptic applications. One microfluidic application provides a system of channels in micrometer scale in order to handle liquids in nanoliter volumes (e.g., reactors for expensive reactants as enzymes). In addition, flat, mirror-like polished surfaces can be prepared on amorphous metallic parts using unstructured molds. Thus, thin plates with large dimensions and mirror finishes on one side can be prepared, if for example, a silicon wafer is used as hot mold. As one example, casting of an amorphous plate of 100 mm diameter and 1 mm thickness can be accomplished using the methods described above.

It should be understood that certain variations and modifications of this invention will suggest themselves to one of ordinary skill in the art. The scope of the present invention is not to be limited by the illustrations or the foregoing descriptions thereof, but rather solely by the appended claims.

What is claimed is:

1. A method of forming an amorphous metallic component, comprising:

providing a mold having a desired pattern thereon;

contacting an ahoy capable of forming an amorphous metal with the mold while both the mold and the allay are at a casting temperature above about 1.5 $T_g$ of the alloy to allow the alloy to wet the mold, both the alloy and the mold having been heated to the casting temperature and cooling the alloy to an ambient temperature to form an amorphous metallic component.

2. The method of claim 1, wherein the mold is made of silicon.

3. The method of claim 1, wherein the casting temperature is above the melting temperature ($T_m$) of the alloy.

4. The method of claim 1, wherein the alloy is heated to a temperature such that the viscosity of the alloy is about $10^2$ poise or less.

5. The method of claim 1, further comprising maintaining the alloy on the mold at the casting temperature for about 5 seconds or more before cooling the alloy.

6. The method of claim 1, wherein the alloy is cooled at a rate of up to about 500 K/sec.

7. The method of claim 1, wherein the mold further comprises a protective layer to provide separation with the alloy.

8. The method of claim 7, wherein the protective layer is $SiO_2$.

9. The method of claim 1, wherein the alloy is a Zr-based alloy.

10. The method of claim 9, wherein the alloy is $Zr_{52.5}Cu_{17.9}Ni_{14.6}Al_{10}Ti_5$.

11. The method of claim 1, wherein the alloy first contacts the mold after both the alloy and the mold are at the casting temperature.

12. The method of claim 1, further comprising heating the alloy and the mold to the casting temperature simultaneously.

13. The method of claim 12, further comprising first contacting the alloy with the mold before heating the alloy and the mold to the casting temperature.

14. A method of forming an amorphous metallic component, comprising:

providing a mold having a desired pattern thereon;

contacting an alloy capable of forming an amorphous metal with the mold while both the mold and the alloy are at a casting temperature wherein the viscosity of the alloy is less than about $10^4$ poise to allow the alloy to wet the mold, both the alloy and the mold having been heated to the casting temperature; and cooling the alloy to an ambient temperature to form an amorphous metallic component.

15. The method of claim 14, wherein the viscosity of the alloy at the casting temperature is less than about $10^4$ poise.

16. The method of claim 14, wherein the alloy first contacts the mold after both the alloy and the mold are at the casting temperature.

17. The method of claim 14, further comprising heating the alloy and the mold to the casting temperature simultaneously.

18. The method of claim 17, further comprising first contacting the alloy with the mold before heating the alloy and the mold to the casting temperature.

19. A method of forming an amorphous metallic component, comprising:

providing a mold having a desired pattern thereon;

contacting an alloy capable of forming an amorphous metal with the mold while both the mold and the alloy are at a casting temperature above the nose of the crystallization curve of the alloy to allow the alloy to wet the mold, both the alloy and the mold having been heated to the casting temperature; and cooling the alloy to an ambient temperature to form an amorphous metallic component.

20. The method of claim 19, wherein the alloy first contacts the mold after both the alloy and the mold are at the casting temperature.

21. The meted of claim 19, further comprising heating the alloy and the mold to the casting temperature simultaneously.

22. The method of claim 21, further comprising first contacting the alloy with the mold before heating the alloy and the mold to the casting temperature.

23. A method of forming an amorphous metallic component having a high aspect ratio, comprising:

providing a mold having a desired pattern thereon, wherein at least a portion of the mold includes a recess having a height greater than a width thereof;

filling the mold with a metallic alloy capable of forming an amorphous metal at an elevated casting temperature, such that both the mold and metallic alloy are at the elevated casting temperature, and wherein both the alloy and the mold have been heated to the casting temperature, wherein the casting temperature is high enough to provide sufficient fluidity to the alloy and wettability to the mold to substantially fill the recess; and cooling the alloy from the casting temperature to an ambient temperature, said cooling occurring prior to crystallization of the metallic alloy, such that an amorphous metallic component is formed replicating the shape of the mold.

24. The method of claim 23, wherein the casting temperature is above about 1.5 $T_g$ of the alloy.

25. The method of claim 23, wherein the casting temperature is above about the melting temperature of the alloy.

26. The method of claim 23, wherein the alloy at the casting temperature has a viscosity less than about $10^4$ poise.

27. The method of claim 23, wherein the alloy at the casting temperature has a viscosity less than about $10^2$ poise.

28. The method of claim 23, wherein the casting temperature is a temperature above the nose of the crystallization curve of the alloy.

29. The method of claim 23, further comprising applying pressure to the alloy against the mold.

30. The method of claim 29, wherein applying pressure to the alloy simultaneously cools the alloy from the casting temperature to the ambient temperature.

31. The method of claim 30, wherein applying pressure comprises applying a heat sink against the alloy.

32. The method of claim 23, wherein the height to width ratio of the recess is greater than about three.

33. The method of claim 23, further comprising heating both the alloy and the mold to the elevated casting temperature before filling the mold with the alloy.

34. The method of claim 33, wherein the alloy first contacts the mold before heating the alloy and the mold to the elevated casting temperature.

35. The method of claim 33, wherein the alloy first contacts the mold after heating the alloy and the mold to the elevated casting temperature.

* * * * *

UNITED STATES PATENT AND TRADEMARK OFFICE

CERTIFICATE OF CORRECTION

PATENT NO. : 6,620,264 B2
APPLICATION NO. : 09/879545
DATED : September 16, 2003
INVENTOR(S) : Kundig et al.

It is certified that error appears in the above-identified patent and that said Letters Patent is hereby corrected as shown below:

Column 7

Line 23, delete “microstuctures” and insert --microstructures --

Line 48, delete “ahoy” and insert --alloy --

Line 49, delete “allay” and insert -- alloy --

Line 53, before “and” insert -- ; --

Column 8

Line 55, delete “meted” and insert--method --

Signed and Sealed this

Eighth Day of August, 2006

JON W. DUDAS
*Director of the United States Patent and Trademark Office*